US010900747B2

(12) United States Patent
Kilic

(10) Patent No.: US 10,900,747 B2
(45) Date of Patent: Jan. 26, 2021

(54) TURRET FOR RIFLE SCOPES

(71) Applicant: Michael Ali Kilic, Schwebheim (DE)

(72) Inventor: Michael Ali Kilic, Schwebheim (DE)

( * ) Notice: Subject to any disclaimer, the term of this patent is extended or adjusted under 35 U.S.C. 154(b) by 0 days.

(21) Appl. No.: 16/107,195

(22) Filed: Aug. 21, 2018

(65) Prior Publication Data

US 2019/0072363 A1 Mar. 7, 2019

Related U.S. Application Data

(60) Provisional application No. 62/550,177, filed on Aug. 25, 2017.

(51) Int. Cl.
*F41G 1/38* (2006.01)
*F41G 1/46* (2006.01)

(52) U.S. Cl.
CPC *F41G 1/38* (2013.01); *F41G 1/46* (2013.01)

(58) Field of Classification Search
CPC .... F41G 1/38; F41G 1/46; G02B 7/16; G02B 21/248
USPC ..... 42/122
See application file for complete search history.

(56) References Cited

U.S. PATENT DOCUMENTS 7,612,952 B2 * 11/2009 Schafer ..... F41G 1/38 359/813
7,937,879 B2 5/2011 Hamilton
8,166,697 B1 5/2012 Sueskind
8,919,026 B2 12/2014 Hamilton
8,984,796 B2 * 3/2015 Thomas ..... F41G 1/28 42/119
9,062,934 B1 * 6/2015 Presley ..... F41G 1/387
9,170,068 B2 * 10/2015 Crispin ..... F41G 1/16
9,182,773 B2 * 11/2015 Campean ..... G05G 1/082
9,435,609 B2 9/2016 Hamilton
9,677,848 B2 * 6/2017 Hamilton ..... G02B 23/16
10,101,122 B2 * 10/2018 Davidson ..... F41G 1/38
2016/0040959 A1 2/2016 Davidson et al.
2016/0370146 A1 12/2016 Hamilton

* cited by examiner

*Primary Examiner* — Stephen Johnson
*Assistant Examiner* — Benjamin S Gomberg
(74) *Attorney, Agent, or Firm* — Ian Burns; ATIP Law

(57) ABSTRACT

Elevation turrets are used in rifles copes to adjust the point of aim of in the vertical direction. In tactical riflescopes used for precise shooting at long distance, the shooter often adjusts the elevation turret via very small movements or 'clicks'. Each click indicates a fine adjustment step, often ½ MOA or ¼ MOA (Minute of Arc). At night or under stressful field conditions, it is difficult for the shooter to see the click markings or remember whether the turret has been turned once or twice.

The present invention discloses an elevation turret that features a moving pin. The pin protrudes from the top of the turret if the turret is turned more than once. This can provide tactile feedback to the shooter and help him re-adjust his point of aim in the dark or when wearing gloves.

13 Claims, 9 Drawing Sheets

TURRET FOR RIFLE SCOPES

CROSS-REFERENCE TO RELATED APPLICATION

This application claims priority to U.S. provisional patent application Ser. No. 62/550,177 filed 25 Aug. 2017, the contents of which are herein incorporated by reference.

FIELD OF THE INVENTION

The present invention relates to an turrets for riflescopes. The disclosed turret features tactile feedback that may assist to indicate the rotational state of the turret and in particular whether the turret has undergone a complete turn. The turret has particular application as an elevation turret, but may also be used as a windage turret.

BACKGROUND OF THE INVENTION

A rifle scope (also called a "scope" for short) is an optical aiming device which improves the accuracy of a firearm by providing the shooter with a magnified image of distant targets. In a rifle scope, the "point of aim" is usually designated by a reticle or cross hairs. Reticles are most commonly represented as intersecting lines in a '+' shape though many variations exist, including dots, posts, circles, etc. In a rifle scope, the reticle's shape is superimposed on the target image to provide a precise indication of the point of aim.

Modern rifle scopes are equipped with at least two control knobs or turrets for making elevation (up-down) and windage (left-right) adjustments. These turrets allow for precise vertical and horizontal movement of the reticle so that the sight's point of aim can be aligned with the firearm's "point of impact".

The point of aim in a rifle scope is set to match the "point of impact" of the rifle at a given distance (for example, 100 meters). This is called zeroing-in the riflescope. It is necessary to re-adjust the scope in cases when the target to be aimed is at different distances. For instance, if a riflescope has been zeroed-in at 100 meters, it needs to be re-adjusted when the distance to the target becomes 200 meters or 300 meters. This adjustment is performed by dialing (turning) the elevation turret.

The turrets used for elevation adjustment are usually marked with scales or indicia that show the amount of angular adjustment in units that could be as small as ¼ MOA (Minute of Arc). They are also designed such that moving from one position to the next makes a "click" so the shooter can also hear or feel how many minutes of arc (MOA) he has dialed into his rifle scope. However, since the dialing or setting of the elevation turret is a precision process, it is difficult to set the turret to the desired distance especially in dark environments or when wearing gloves. The problem is compounded when the turret can turn more than once. This makes it very challenging to reset a multi-turn turret to its original zeroed-in position.

Various developments have been made in the art with the goal of identifying the number of revolutions in an elevation turret:

U.S. Pre-Grant Publication No. 20160040959 appears to disclose a rifle scope turret for rifle scopes. The turret includes a dial assembly and a stop assembly. The dial assembly includes an indicator at the top that can provide a user with a visual and/or tactile indication of how many revolutions the dial assembly has completed. The indicator indicates whether the dial assembly is in a first revolution or a second revolution.

U.S. Pre-Grant Publication No. 20160370146 also discloses a scope turret. This invention comprises a movable optical element defining an optical axis enclosed by the scope body and a turret having a screw operably connected to the optical element for adjusting the optical axis in response to rotation of the screw. The turret defines first and second stop surfaces positioned for engagement by the spiral cam to limit rotation of the turn. The first stop surface defines a zero position of the screw and the movable optical element. The second stop surface, on the other hand, defines a maximum point of displacement of the screw and the optical element. The indexing portion of the elevation turret comprises a clicker and a toothed surface. Therefore, the clicking sound can inform the shooter of how many rotations have been completed during dialing.

Another prior art document, U.S. Pat. No. 8,166,697 discloses a rifle scope indicia system that allows a user to instantly set the scope for a predetermined distance shot. The rifle scope indicia system includes a mounting base and a plurality of marker pins. In this invention, the marker pins are of different heights. Thus, it becomes possible for a user to perform tactile identification of the pins. For example, it would be beneficial to have a reference distance marker pin with a white color and the greatest height. Some of the marker pins could be made translucent to allow light to be transmitted therethrough for night time shooting conditions.

It is evident from the above review of the state of the art that there is a need for an elevation turret that can offer a simple and positive way of showing the number of turns, and further, can be used in the dark or under stressful conditions.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to provide a tactile indication that an adjustment turret has been rotated more than one revolution;

provide a visual indication that an adjustment turret has been rotated more than one revolution;

provide a simple mechanical means for indicating the rotation state of an adjustment turret.

These and other advantages may be realized by reference to the remaining portions of the specification, claims, and abstract.

Brief Description of One Embodiment of the Present Invention

This invention teaches a turret which features a pin protruding from its top. The pin moves up when the turret is dialed past the first turn. This can give tactile feedback to the shooter and help him re-adjust his scope to the original zero-in distance very simply even under dark or when the shooter is wearing gloves.

In one aspect, there is a provided a turret for a riflescope. The turret may comprise a main component comprising a perimeter wall that defines a longitudinal axis, the perimeter wall comprising a top end. A dialing component may comprise a circumferential side wall that defines an internal cavity that at least partially receives the main component therein. The dialing component may be mounted for rotation relative to the main component about the longitudinal axis from a base position for greater than one complete revolution. A pin hole may be provided in an end wall of the dialing component. A pin may be disposed within the cavity in alignment with the pin hole, the pin moveable through the pin hole between a first position and a second position, wherein the pin protrudes externally of the pin hole in at least one of the first position and the second position. A driver may drive the pin between the first position and the second position. Rotating the dialing component to a position past one complete revolution from the base position may cause the driver to drive the pin from the first position to the second position.

In one aspect, there is provided an elevation turret for use in a riflescope. The turret may comprise a main component shaped in the form of a cylinder, said main component comprising an axis of rotation and a top perimeter, a dialing component shaped in the form of a hollow cylinder, said dialing component comprising a top surface comprising a perimeter, an outer side and an inner side, said dialing component further comprising a pin hole through said top surface near said perimeter, said dialing component being positioned on top of said main component. There may be a driver in the form of a hollow cylinder, the driver comprising a top end, a bottom end, an outer surface and an inner surface. The driver may comprise an opening on its outer surface and a parabolic channel through its inner surface. There may be a retainer attached to the inner side of the top surface of the dialing component, the retainer holding the driver such that it is positioned directly under the pin hole through the top surface of the dialing component. A thin rod comprising a bottom end and a top end, the bottom end of said thin rod may be attached to the top perimeter of the main component such that its length is parallel to the axis of rotation of the main component, the thin rod being positioned such that its top end could move into the opening on the outer surface of the driver when the dialing component is rotated to a predetermined degree. A pin comprising a top end and a bottom end, the top end of said pin may be positioned inside the pin hole such that it can protrude from the top surface of the dialing component, the bottom end of the pin being positioned inside said driver, the pin being positioned such that it can move in upward or downward direction within the pin hole and within the driver. The pin may comprise a spike near its bottom end, the spike being perpendicular to the pin, the spike being positioned inside the parabolic channel through the inner surface of said driver. Rotating the dialing component past a first turn may result in the top end of the pin protruding from the top surface of the dialing component thus providing tactile feedback to an operator on the fact that the dialing component has been turned more than once.

In one aspect, there may be provided a turret for a riflescope. The turret may comprise dialing component means for adjusting a position of a reticle of the riflescope, the dialing component means comprising a pin hole. The turret may comprise main component support means for rotationally supporting the dialing component means, the dialing component means rotatable from a base position. The turret may comprise pin means moveable between a first position and a second position for indicating a state of rotation of the dialing component means, the pin means disposed in alignment with the pin hole means. The turret may comprise driver means for driving the pin means between the first position and the second position as the dialing component means is rotated through one complete rotation from the base position.

The above description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

The foregoing aspects and many of the advantages of this invention will become more readily apparent with reference to the following detailed description of the invention, when taken in conjunction with the appended claims and accompanying drawings, wherein:

GLOSSARY OF TERMS AND REFERENCE NUMERALS

Figure 1:
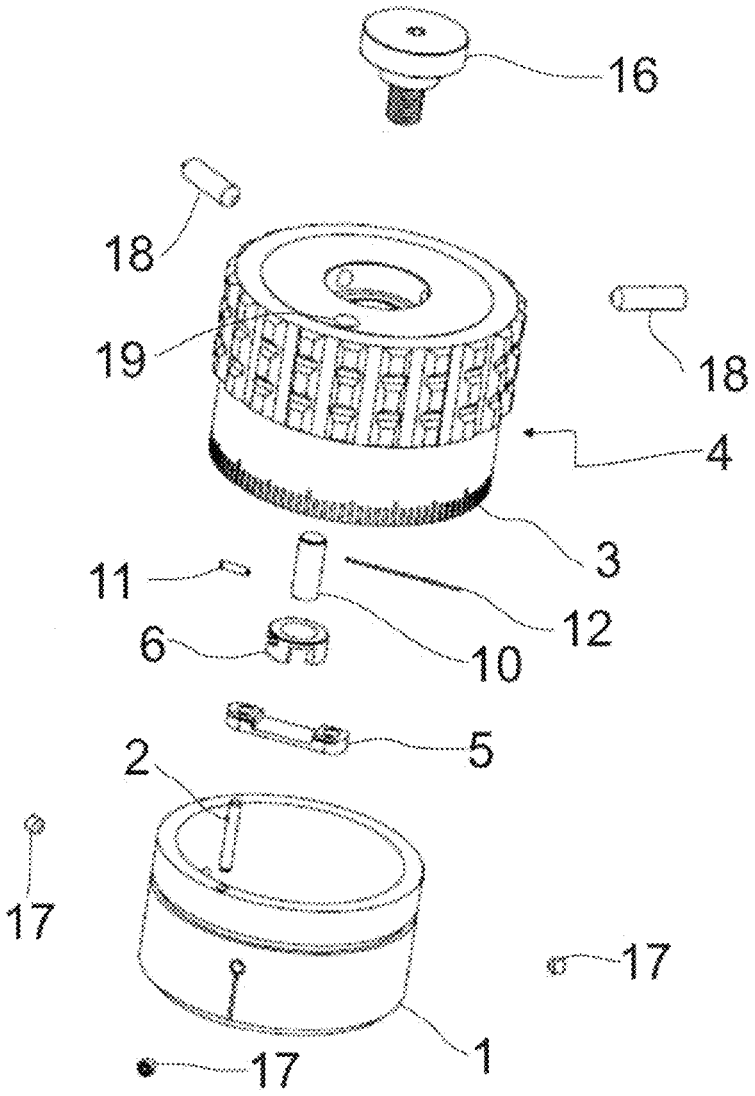
FIG. 1 is an exploded view of the elevation turret according to an embodiment of the invention.

To help the reader understand the invention better, the names of specific components of the invention and their corresponding reference numerals are listed below.

1. Main component
2. Thin rod
3. Ring
4. Dialing component
5. Retainer
6. Driver/cylinder
7. Parabolic channel
8. Opening
9. Locking surface
10. Pin
11. Spike
12. Spring steel
13. Scope
14. Scope mount
15. Elevation component
16. Screw
17. Bolt
18. Turret cotter pin
19. Pin hole
20. Sleeve
21. Slot
22. Gap
23. Recess
24. Screw hole

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 2:
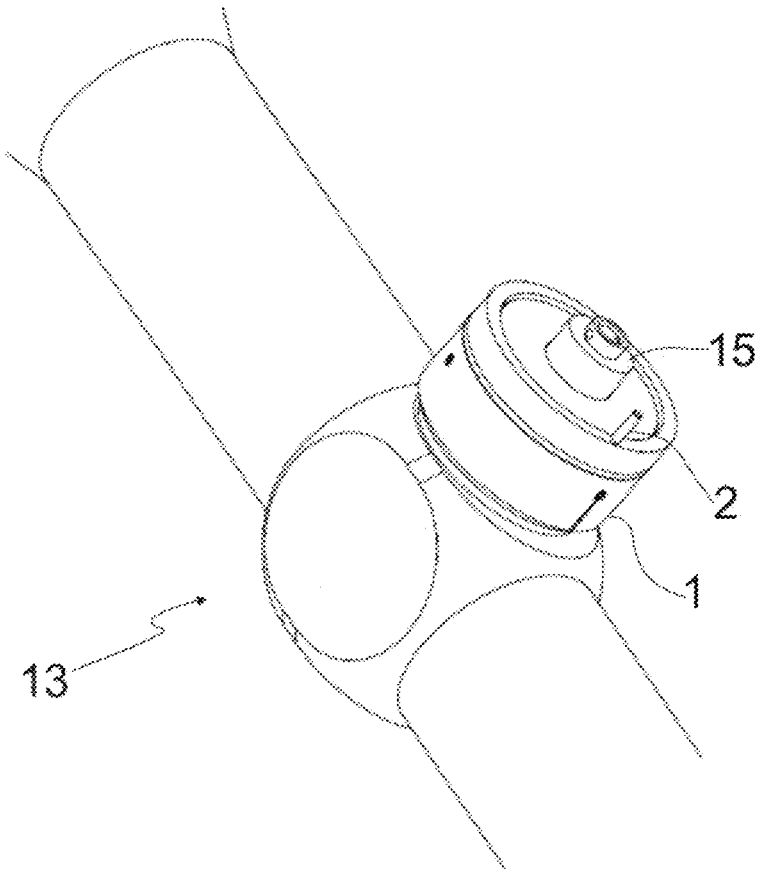
FIG. 2 is a perspective view of a rifle scope showing how the elevation turret will be connected.

With reference to FIG. 2, an elevation turret according to one embodiment of the invention comprises a cylindrical main component (1) that is mounted on the scope (13). The main component (1) is attached to the main body of the scope (13) by means of cotter pins or bolts (17) or other suitable attachment such that it does not rotate relative to the scope. The main component has a longitudinal axis being the axis of the cylinder. A thin rod (2) is attached to the top surface of the main component (1) by any suitable means. In one embodiment, the thin rod (2) may have a threaded end that is received into a threaded hole on the end surface of the main component. The thin rod (2) is positioned such that its length is parallel to the longitudinal axis, i.e., to the axis of the main component (1). The thin rod (2) is disposed off the longitudinal axis and in one particular embodiment is disposed near the periphery of the main component. The thin rod (2) is a fixed element relative to the main component that provides an actuator for a driver as will be described in more detail below.

A second component of the invention is the dialing component (4). It is rotationally mounted on top of the main component (1) and fixed to an elevation component (15) by means of a screw (16). The dialing component may be generally cylindrical having a circumferential side wall, an open end to an internal cavity, and a closed end. In the depiction as shown, the closed end is the top end of the dialing component. The main component is partially received into the internal cavity through the open end. The elevation component (15) is connected to the internal mechanism of the scope (not shown) which adjusts the position of the reticle. Cotter pins 18 may be used for locking the dialing component (4) to the screw (16) so that as the dialing component rotates on the main component, the screw (16) will rotate to adjust the reticle. Therefore, elevation adjustment of the scope (13) is done by the up and down movement of the elevation component (15) according to the degree and the direction of rotation of the dialing component (4). This implies that the dialing component (4) will be elevated upon elevation of the elevation component (15) and will be lowered upon lowering of the elevation component (15). The dialing component may have a base position, being a stop beyond which the dialing component cannot turn further in a given direction. In one embodiment, the base position may be considered to be the lowermost position that the dialing component can be turned in the clockwise direction. From the base position, the dialing component may be able to turn more than one complete turn or rotation of the dialing component, e.g. in the anti-clockwise direction.

Figure 3:
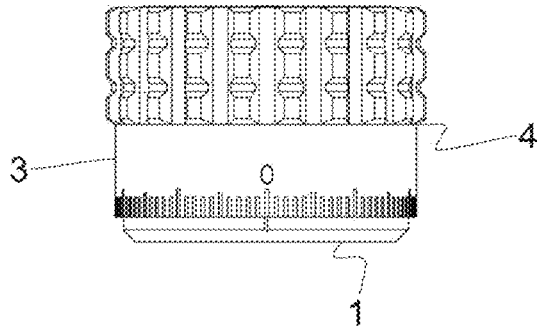
FIG. 3 is a side view of the elevation turret.

With reference to FIG. 3, a ring (3) which has lines, numbers or other suitable indicia marked on it is provided to show the degree of dialing (elevation adjustment). The ring (3) is mounted on the lower portion of the dialing component (4). The base position may be represented by a particular marking or indicia on the ring (3), e.g. by a zero on a number scale. However, the base position differs from the zeroed-in position. The zeroed-in position is the position of the elevation turret at which the scope is known to the shooter to be accurate for a specific range. For example, the zeroed-in position may be half a revolution of the elevation turret from the base position and may represent a range of 100 yards. The parameters of the zeroed-in position will change with various factors, such as wind speed etc.

Figure 4:
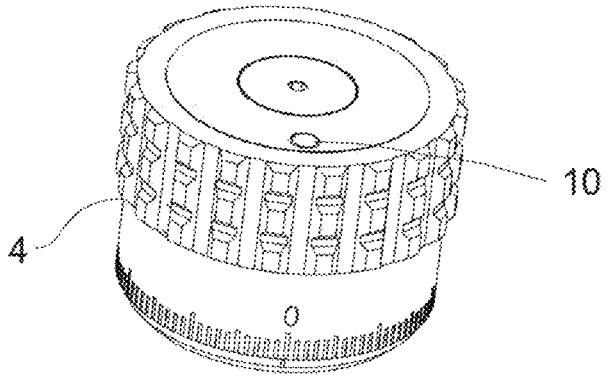
FIG. 4 is a perspective view of the elevation turret showing the dialing component and the position of the pin whole.
Figure 5:
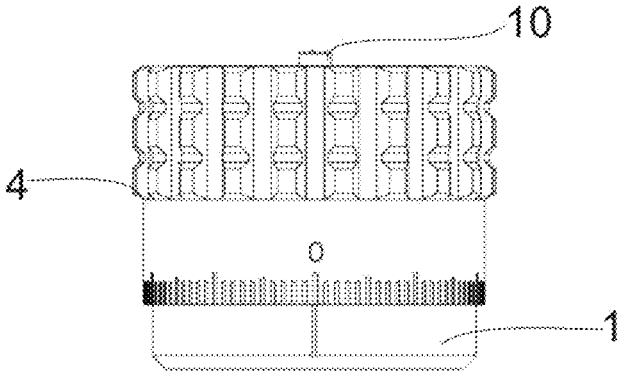
FIG. 5 is a side view of the elevation turret showing the pin protruding from the top of the dialing component (compare with FIG. 3)
Figure 6:
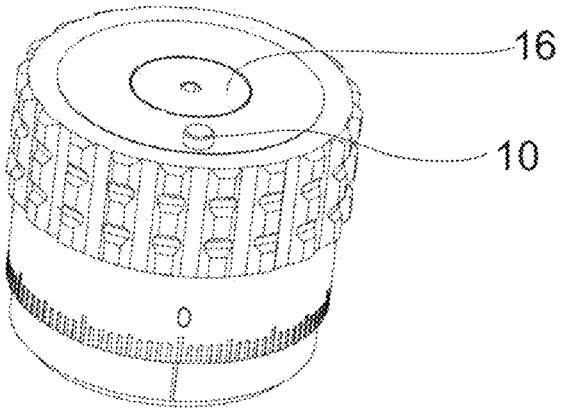
FIG. 6 is a perspective view of the elevation turret showing the pin protruding from the top of the dialing component (compare with FIG. 4)
Figure 7:
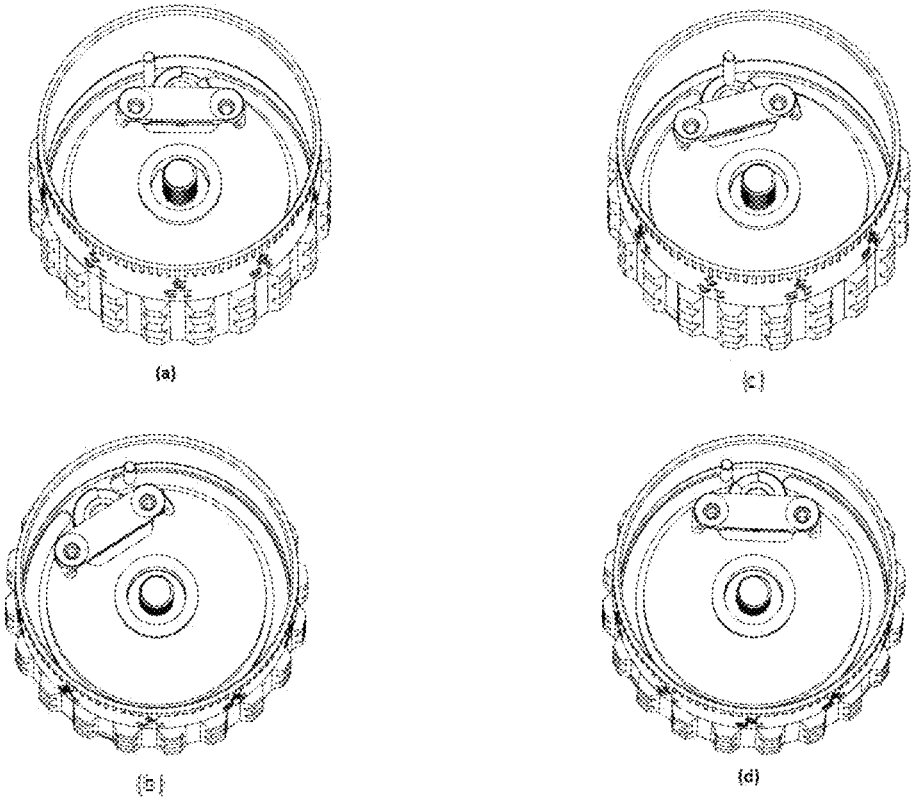
FIGS. 7 (*a*) through (*d*): show perspective views of the inside of the dialing component. These figures show, in sequence, how turning the dialing component past a specific position causes the thin rod to tip the driver and cause it to turn. This, in turn, will push the pin upward and make it protrude from the top of the dialing component.
Figure 8:
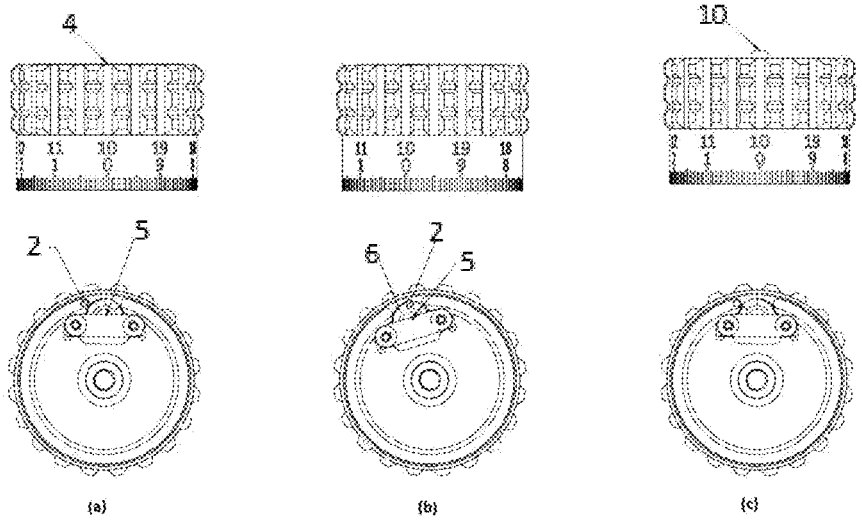
FIGS. 8 (*a*) through (*c*): show side views and bottom views of the dialing component. These figures show, in sequence, how turning the dialing component past a specific position causes the thin rod to tip the driver and cause it to turn. This, in turn, will push the pin upward and make it protrude from the top of the dialing component.

With reference to FIGS. 4, 5 and 6, a pin hole (19) is drilled in the top surface of the dialing component (4). A pin (10) is positioned in alignment with the pin hole (19) such that its top end can move up and protrude from the top surface of the dialing component (4). The pin (10) is attached to the underside of the dialing component (4) via a driver (6) which is itself held in position by the retainer (5). This is shown in FIGS. 1, 7 and 8. The pin can be driven by the driver from a first position in which the pin does not substantially protrude from the pin hole to a second position in which the pin does protrude above the top surface of the dialing component and therefore can be felt by the user.

Figure 9:
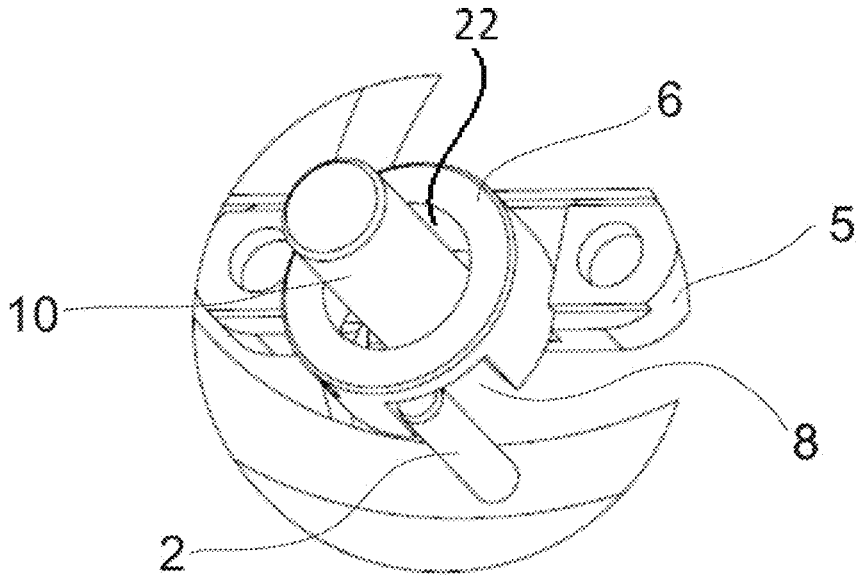
FIG. 9 is a close-up perspective view of the thin rod, the driver, and the retainer when the first revolution of the dialing component is about to be completed.

The driver (6) is in the form of a hollow cylinder. As shown in the closeup views in FIGS. 9 and 10, a parabolic channel (7), a square shaped opening (8) and locking surfaces (9) are cut in the driver (6). The driver (6) is fitted in the retainer (5) by way of a spring steel (12). The retainer (5) may be secured to the underside top surface of the dialing component (4) by suitable fasteners, such as screws etc. The retainer (5) defines a placement channel for the hollow cylinder (6). The placement channel is between the spring (12) and the inner wall of the dialing component, with the spring 12 urging the cylinder (6) against the wall of the dialing component.

The parabolic channel extends both circumferentially and longitudinally along the inner wall of the cylinder (6). That is, the channel may be considered to extend generally diagonally along the inner wall of the cylinder (6). While the channel (7) is shown as extending all the way through the wall of the cylinder from the inner side to the outer side, this is not a requirement. The pin (10) has a connector member such as a spike (11) perpendicularly protruding from its lower end. The lower end of the pin (10) is positioned inside the driver (6) such that the spike (11) is fitted inside the parabolic channel (7). Therefore, if the driver (6) rotates, the pin (10) will move up and down as the spike traverses the channel (7).

Figure 11:
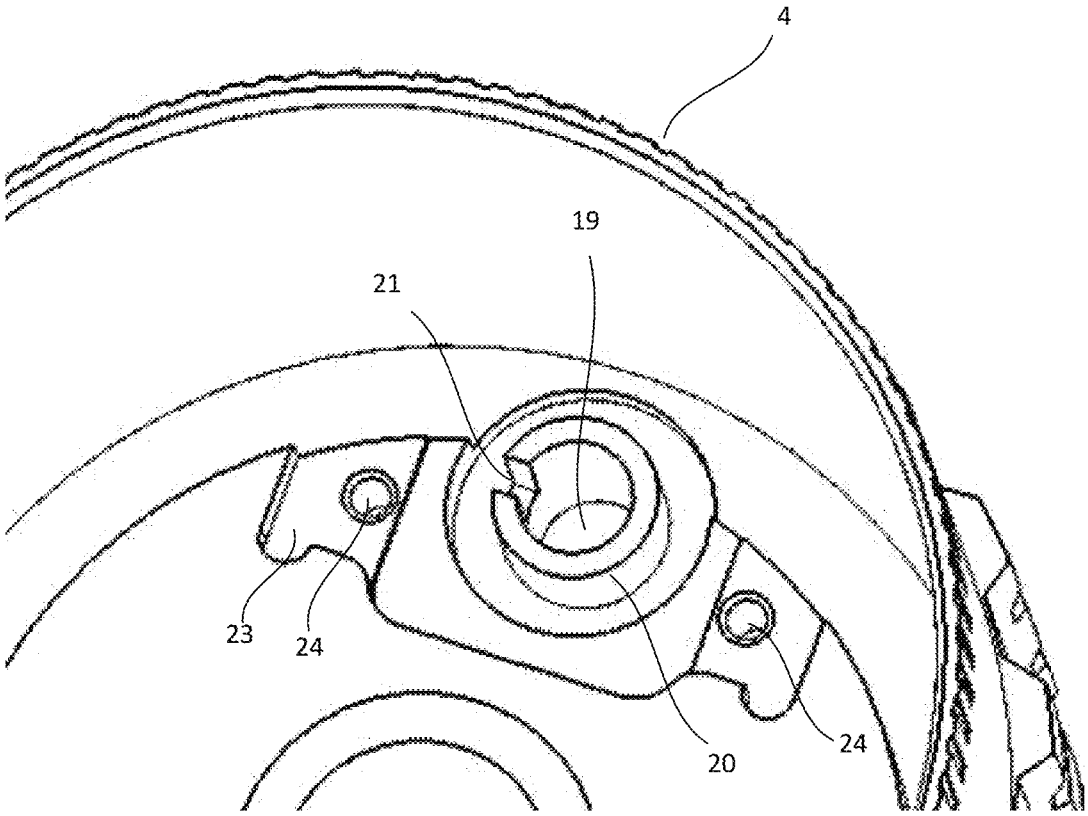
FIG. 11 is a partial perspective showing a portion of the inner surfaces where the driver and retainer are to be located.

The driver (6) is positioned such that as the dialing component (4) completes a first complete rotation from its base position, the actuator rod (2) will engage the driver (6). That is, the thin rod (2) will enter the opening (8) cut into the driver (6). Upon further rotation of the dialing component (4), the thin rod (2) will make the driver (6) rotate by a predetermined amount before moving out of the opening (8). Rotation of the cylinder (6) causes the spike (11) to traverse the channel which drives the pin (10) from the first position (non-protruding) to the second position (protruding). To prevent the pin (10) and spike (11) from rotating with the cylinder (6), the inner surface of the dialing component (4) may be milled with a sleeve (20) that extends inwards from underneath the top surface of the dialing component (4). The sleeve (20) can be seen in the illustration of FIG. 11 and provides an extension of the pin hole (19). The sleeve (20) includes a vertical slot (21) that receives the spike (11). When assembled, the pin (10) passes through the sleeve (20) and the pin hole (19). The driver cylinder (6) is mounted about the sleeve (20) and can freely rotate on the sleeve (20). Thus, the sleeve (20) is provided in the gap (22) seen in FIG. 9 between the pin (10) and the cylinder (6). The vertical slot in the sleeve accommodates the spike (11) and allows the spike (11) to slide up and down the slot to raise and lower the pin (10) as the spike traverses the cylinder channel (7). The fixed sleeve prevents the pin (10) from rotating with the cylinder (6). FIG. 11 also shows a milled recess 23 that may be provided in the undersurface of the top of the dialing component (4) for accommodating the retainer (5) and driver (6). The retainer may be secured into this recess (23) via screws through screw holes (24).

The rotation sequence of the driver (6) is illustrated in FIGS. 7(*a*) through (*d*). FIG. 7(*a*) shows the dialing component viewed from below and the actuator rod (2). In FIG. 7(*a*), the dialing component is in the base position in which the cylinder (6) is up against the actuator rod (2). FIG. 8(*a*) shows a corresponding side view of the dialing component in which the scale markings show a zeroed position and the pin is in the first position and does not protrude above the surface of the dialing component. In FIG. 7(*b*), the dialing component has been rotated anticlockwise (clockwise in the lower view of FIG. 7) relative to the fixed actuator rod (2) through nearly one full rotation from the base position and is about to engage the driver cylinder (6). In FIG. 7(*c*), the actuator rod (2) has entered the opening (8) of the cylinder and engage the cylinder wall so that any further rotation of the dialing component will cause the cylinder to rotate. FIG. 8(*b*) shows the corresponding side view in which it can be seen from the scale markings that the dialing component has gone from the zero position to nearly one full turn. The pin remains in the first position. It can be seen that the opening 8 generally faces to the right as viewed in FIGS. 7(*a*) through (*c*). FIG. 7(*d*) shows the sequence advanced by further turning of the dialing component. It can be seen that the actuator rod (2) has actuated the driver to rotate as evidenced by the opening now facing generally left as viewed in FIG. 7(*d*). The dialing component has been rotated sufficiently that the actuator rod (2) has moved out of the opening 8 of the cylinder. FIG. 8(*c*) shows the corresponding side view. The dialing component, having undergone a full rotation, is again reading zero on the scale, but now the pin has been driven to the second position and thus protrudes above the dialing component. This gives tactile and visual feedback to the user that the dialing component has undergone a complete rotation. The user may therefore read the upper scale markings on the dialing component to correctly interpret the turret position and adjustment.

From the above description of FIGS. 7 and 8, it can be seen that the pin is not driven continuously from the first position to the second position as the dialing component rotates, but is only driven through a relatively small arc of rotation as the dialing component completes a full rotation. This may be desirable because it gives a clear indication as to the state of rotation. If the pin were to protrude more gradually as the dialing component rotates, then it may be more difficult to interpret the state of rotation of the dialing component, in particular while wearing gloves or in low light conditions. In one embodiment, the driver may drive the pin between first and second positions through less than approximately 25 degrees of rotation of the dialing component, e.g. approximately 10-20 degrees of rotation. This may be modified by changing the diameter of the cylinder and/or the width of the opening (8).

If the dialing component continues to be rotated for a second complete turn, the driver (6) will be sufficiently elevated to avoid the actuator (2).

Figure 10:
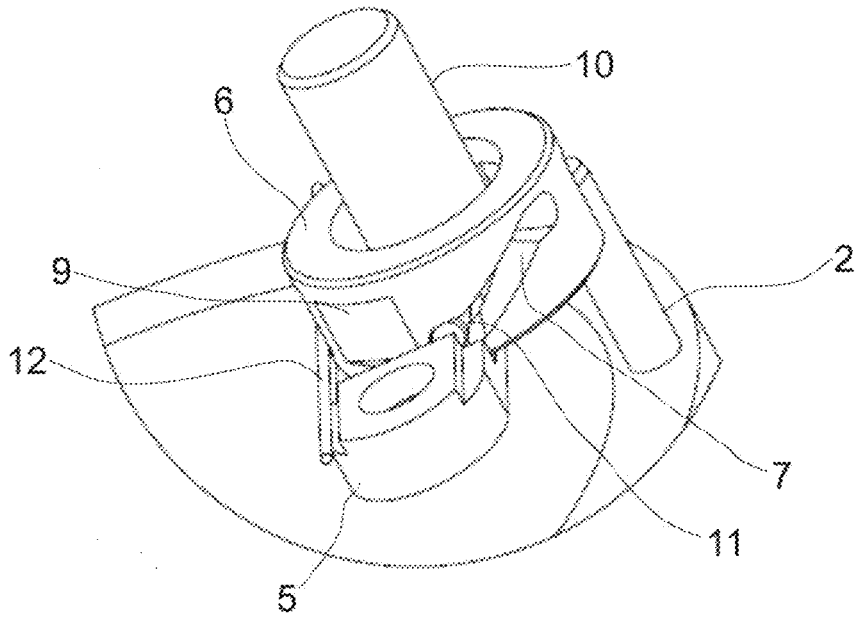
FIG. 10 is another perspective view of the thin rod, the driver, and retainer when the first revolution of the dialing component is about to be completed.

As shown in FIG. 10, the driver (6) includes locking surfaces (9) formed in an outer surface of the cylinder. The locking surfaces (9) are flattened areas that are able to engage the spring steel (12). Free (i.e., undriven) rotational movement of the driver (6) is restrained when the locking surfaces (9) arranged on the outer side of the driver (6) contact with the spring steel (12). The spring steel pushes against the flattened area of the locking surface (9) and urges the driver against the wall of the dialing component. Therefore, when the thin rod (2) is disengaged from the driver (6), the driver (6) remains stable in either of the first position or the second position and the pin (1) will be held in its position above or below the top surface of the dialing component (4).

When the dialing component (4) is rotated in reverse direction, the elevation component (15), and hence the dialing component (4) is lowered. If the dialing component (4) has been turned more than two complete rotations, then turning it in reverse direction will not put the driver (6) in contact with the thin rod (2). This is because the opening (8) in the driver (6) passes over the thin rod (2). If one continues to turn the dialing component (4) in the reverse direction, then the opening (8) disposed in the driver (6) will eventually make contact with the thin rod (2). When the contact occurs, the spike (11) is located in the upper portion of the parabolic channel (7). At the same time, the thin rod (2) will move into the opening (8) and will prevent the driver (6) from moving in dialing direction. The driver (6) then rotates around its own axis in reverse direction to the movement of the dialing component (4). As the driver (6) rotates, the spike (11) moves downwards in the parabolic channel (7) and will eventually rest in the bottom portion of the parabolic channel (7). Since the spike (11) is attached to the pin (10), the pin (10) will be lowered such that its tip no longer protrudes from the top surface of the dialing component (4).

While specific reference has been made to an elevation turret, it will be apparent to the person skilled in the art that the embodiments described herein could equally be deployed as windage turrets if required and all such types of turrets are intended to be encompassed herein.

The foregoing description reveals the general nature of the invention clearly and fully such that others can, by applying knowledge within the skill of the art, readily build and use the invention.

It will be understood by the person skilled in the art that terms of orientation such as top, bottom, front, back, left, right, inner, outer, etc. are used herein with reference to the drawings in order to provide a clear and concise description. Such terms are not intended to limit the examples and embodiments in any manner and the scope of the invention as defined herein will encompass other possible orientations of the components as will be perceived by the person skilled in the art.

It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art. Thus, the scope of the invention should be determined by the appended claims and their legal equivalents, as opposed to the description given in the specifications.

What is claimed is:

1. A turret for use in a riflescope comprising:

(A) a main component comprising a perimeter wall that defines a longitudinal axis, the perimeter wall comprising a top end;

(B) a dialing component comprising:

(a) a circumferential side wall that defines an internal cavity that at least partially receives the main component therein through an opening at a first end of the dialing component, the dialing component being mounted for rotation relative to the main component about the longitudinal axis from a base position for greater than one complete revolution; and (b) an end wall at a second end of the dialing component opposite the first end, the end wall comprising a perimeter, an outer side, an inner side, and a pin hole through the end wall;

(C) a pin disposed within the cavity in alignment with the pin hole, the pin moveable through the pin hole along a range of travel extending between a first position and a second position, wherein the pin protrudes externally outward of the outer side of the end wall in at least one of the first position and the second position; and (D) a driver for driving the pin between the first position and the second position;

(E) whereby rotating the dialing component to a position past one complete revolution from the base position causes the driver to drive the pin from the first position to the second position;

(F) wherein the driver drives the pin along the range of travel from the first position to the second position, or from the second position to the first position through less than a full rotation of the dialing component.

2. The turret of claim 1 wherein the driver drives the pin from the first position in which the pin does not protrude externally of the pin hole to the second position in which the pin protrudes from the pin hole and can provide tactile feedback to an operator that the dialing component has been revolved more than one complete revolution from the base position.

3. The turret of claim 1 comprising an actuator that actuates the driver.

4. The turret of claim 3 wherein the actuator comprises a fixed element that is fixed relative to the main component, wherein the fixed element is disposed to engage the driver as the driver is rotated past the fixed element.

5. The turret of claim 1 wherein the driver comprises a hollow cylinder that accommodates the pin within the cylinder, the cylinder having a cylinder axis that is parallel to the longitudinal axis, wherein an actuator is configured to cause the cylinder to rotate about the cylinder axis and wherein rotation of the cylinder drives the pin between the first position and the second position.

6. The turret of claim 5 comprising a retainer for retaining the cylinder against an inner surface of the dialing component in a manner that allows rotation of the cylinder about the cylinder axis.

7. The turret of claim 6 wherein the cylinder comprises one or more locking surfaces, at least one of the one or more locking surfaces preventing free rotation of the cylinder when the pin is in the second position.

8. The turret of claim 7 wherein the one or more locking surfaces comprise one or more flattened surfaces on an outside surface of the cylinder, the turret comprising one or more spring members for engaging the one or more flattened surfaces.

9. The turret of claim 5 wherein the cylinder comprises a channel on an inner surface of the cylinder, the channel extending circumferentially and longitudinally, wherein the pin comprises a connector member extending radially outward of the pin into the channel, wherein movement of the connector member along the channel displaces the pin along the longitudinal axis of the cylinder.

10. The turret of claim 5 wherein the cylinder comprises an opening in a circumferential wall of the cylinder that engages the actuator.

11. The turret of claim 10 wherein the opening extends from an end face of the cylinder.

12. The turret of claim 5 wherein the actuator is disposed relative to the cylinder such that during a first complete revolution of the dialing component from the base position, the actuator engages the cylinder and during a second revolution of the dialing component from the base position, the actuator avoids the cylinder.

13. The turret of claim 1 wherein the driver drives the pin between the first and the second positions through less than 25 degrees of rotation of the dialing component.

* * * * *